US007261222B2

(12) United States Patent
Su

(10) Patent No.: US 7,261,222 B2
(45) Date of Patent: Aug. 28, 2007

(54) STRUCTURE FOR GREEN NOZZLE

(76) Inventor: Cheng-Yuan Su, P.O. Box 44-2049, Taipei (TW) 10668

( * ) Notice: Subject to any disclaimer, the term of this patent is extended or adjusted under 35 U.S.C. 154(b) by 259 days.

(21) Appl. No.: 11/039,788

(22) Filed: Jan. 24, 2005

(65) Prior Publication Data

US 2006/0163288 A1 Jul. 27, 2006

(51) Int. Cl.
*B65D 88/54* (2006.01)

(52) U.S. Cl. ..... 222/321.2; 222/321.7; 222/321.9

(58) Field of Classification Search ..... 222/321.7, 222/321.9, 321.2, 385, 383.1
See application file for complete search history.

(56) References Cited

U.S. PATENT DOCUMENTS

| | | | | |
|---|---|---|---|---|
| 4,071,172 | A * | 1/1978 | Balogh | 222/321.7 |
| 4,371,097 | A * | 2/1983 | O'Neill | 222/321.7 |
| 5,813,571 | A * | 9/1998 | Gaucher | 222/95 |
| 2004/0159681 | A1 | 8/2004 | Crosnier et al. | 222/321.7 |
| 2004/0251280 | A1 | 12/2004 | Crosnier et al. | 222/321.9 |

FOREIGN PATENT DOCUMENTS

| | | |
|---|---|---|
| EP | 1389491 | 2/2004 |

OTHER PUBLICATIONS

British Search Report for Appln. No. GB0506318.5, Jul. 13, 2006.

* cited by examiner

*Primary Examiner*—Frederick C. Nicolas
(74) *Attorney, Agent, or Firm*—Alan Kamrath; Kamrath & Associates PA

(57) ABSTRACT

A structure for a green nozzle includes a, pressing body, a spring, a fixing cover, a piston, a connecting rod, a switch valve and a cylinder. The output tube of the pressing body inserted into the spring, the fixing cover, and the piston is connected to the connecting rod. The spring is installed inside the round dented surface located at the upper part of the fixing cover. The switch valve is inserted into the connecting rod from the lower part such that the cylinder is located at the inner lower part of the fixing cover and is further connected to a straw and installed inside a container. The fixing cover is installed at the opening of the container. Liquids such as lotion or perfume inside the container will not get in contact with the spring of metallic material. Thus, chemical change will not happen, and environmental issues can be ignored. In addition, a simplest assembly can be used to reach the function of ejection of the liquid.

2 Claims, 7 Drawing Sheets

STRUCTURE FOR GREEN NOZZLE

BACKGROUND OF THE INVENTION (a) Field of the Invention

The present invention relates to a structure for a green nozzle and, specifically, relates to a structure where the liquid such as lotion or perfume in the container will not be in contact with metallic material components. Thus, material change won't happen, and environmental issues are taken care of, through the simplest component and assembly to achieve the ejection function of lotion or perfume from the container.

(b) Description of the Related Art

The structure of a prior art nozzle 1, as shown in FIG. 1, includes a pressing body 11, a tooth cover 12, a tube 13, a tube cover 14, a base tube 15, a spring 16, a steel ball 17 and a cylinder body 18. The tube 13 penetrates the slot hole 121 at the center of the tooth cover 12. The upper part of the tube 13 is connected to the pressing body 11, and the lower end of the tube 13 is covered by a base tube 15. At the two sides of the outer edge of the base tube 15 are corresponding small holes 151 for the penetration of liquids such as lotion or perfume into the base tube 15. The base tube 15 is covered by the tube cover 14. Furthermore, the bottom of the base tube 15 is a solid disc. The steel ball 17 is inserted into the cylinder body 18. The hole of the cylinder body 18 decreases from the top to the bottom so that the lower hole diameter of the cylinder body 18 is smaller than the diameter of the steel ball 17. The spring 16 is on top of the steel ball 17. The upper edge opening of the cylinder body 18 is inserted to the bottom edge of the slot hole 121 of the tooth cover 12 so that the bottom of the base tube 15 seals and presses the spring 16. Furthermore, the lower end of the cylinder body 18 is connected to a straw 19.

From the above descriptions, the user first presses on the pressing body 11 to let air in the container immediately eject from the nozzle opening 111 of the pressing body 11. Simultaneously, the siphon effect will bring the liquids, such as lotion or perfume, from the straw 19 with the air into the cylinder body 18. Due to the spring force of the spring 16, the bottom of the base tube 15 will press on the steel ball 17, and the steel ball 17 will block the hole of the cylinder body 18. Furthermore, a gap is generated between the base tube 15 and the tube cover 14 such that the lotion or perfume contained in the cylinder body 18 goes through the gap to the small holes 151 on the two sides of the outer edges of the base tube 15 and penetrates into the base tube 15 and then through the tube 13. The lotion or perfume will be ejected along with air out from the nozzle opening 111 of the pressing body 11. When the pressing body 11 is let go, the liquids such as lotion or perfume remaining in the cylinder body 18 will then go back to the container.

Although the prior art structure for the nozzle 1 achieves the function of the ejection of lotion or perfume, there are so many components which create assembly and disassembly difficulty, and the economy and utility effectiveness is thus reduced. Furthermore, because the spring 16 and the steel ball 17 are made up of metallic material and are installed inside the cylinder body 18, they could cause chemical change for the lotion and perfume in the container, which in turn, could harm the consumers. If the chemically changed lotion or perfume is dumped, this will cause environmental contamination due to difficulty in dilution and recycling.

Therefore, to solve the drawback and inconvenience in the prior art nozzle, the present invention thus provides a more practical structure for a green nozzle which can have a more wide-spread use in the industry and take into account environmental issues as well.

SUMMARY OF THE INVENTION

The nozzle of the present invention includes a pressing body, a fixing cover, a piston, a connecting rod, a switch valve, and a cylinder. One side of the pressing body is installed horizontally with a nozzle. One end of the nozzle is installed vertically with an output tube to be enclosed by a spring a hole. The spring is installed at the round dented surface on top of the fixing cover. The appropriate center of the round dented surface is installed with a hole. The lower part of the hole is installed with a small rod so that the output tube can penetrate and be inserted into the upper edge of the piston. The lower part of the fixing cover is a round rod which is installed at the opening of the container. The connecting rod penetrates from the bottom to the top to the piston hole installed on the piston and is connected to the output tube of the pressing body. The protruding edge at the bottom of the connecting rod touches the dented edge of the piston. The valve rod installed in the switch valve is inserted into the connecting rod from the bottom to the top. The output tube, the piston, the connecting rod and the switch valve of the pressing body are assembled and installed in the upper cylinder room installed in the cylinder. The valve body installed on the switch body is placed inside the lower cylinder room installed in the cylinder. When the valve moves up and down, some locking pieces installed at the appropriate locations of the edge of the valve body will touch the protruding upper locking piece installed inside the cylinder, and the bottom of the cylinder body touches the protruding lower locking piece inside the cylinder.

The main purpose of the present invention is to install the spring above the fixing cover. As the design is without a steel ball, the liquids such as lotion or perfume do not contact components of metallic material. Therefore, no material chemical changes will happen, and environmental issues can be ignored.

The second purpose of the present invention is to use a simple component and assembly to achieve the ejection effect of lotion or perfume from the container.

BRIEF DESCRIPTIONS OF THE DRAWINGS

To facilitate the further understanding of the functions, structure and features of the present invention, a preferred embodiment of the present invention is described in the following accompanied with detailed drawings.

DETAILED DESCRIPTION OF THE PREFERRED EMBODIMENT

Figure 1:
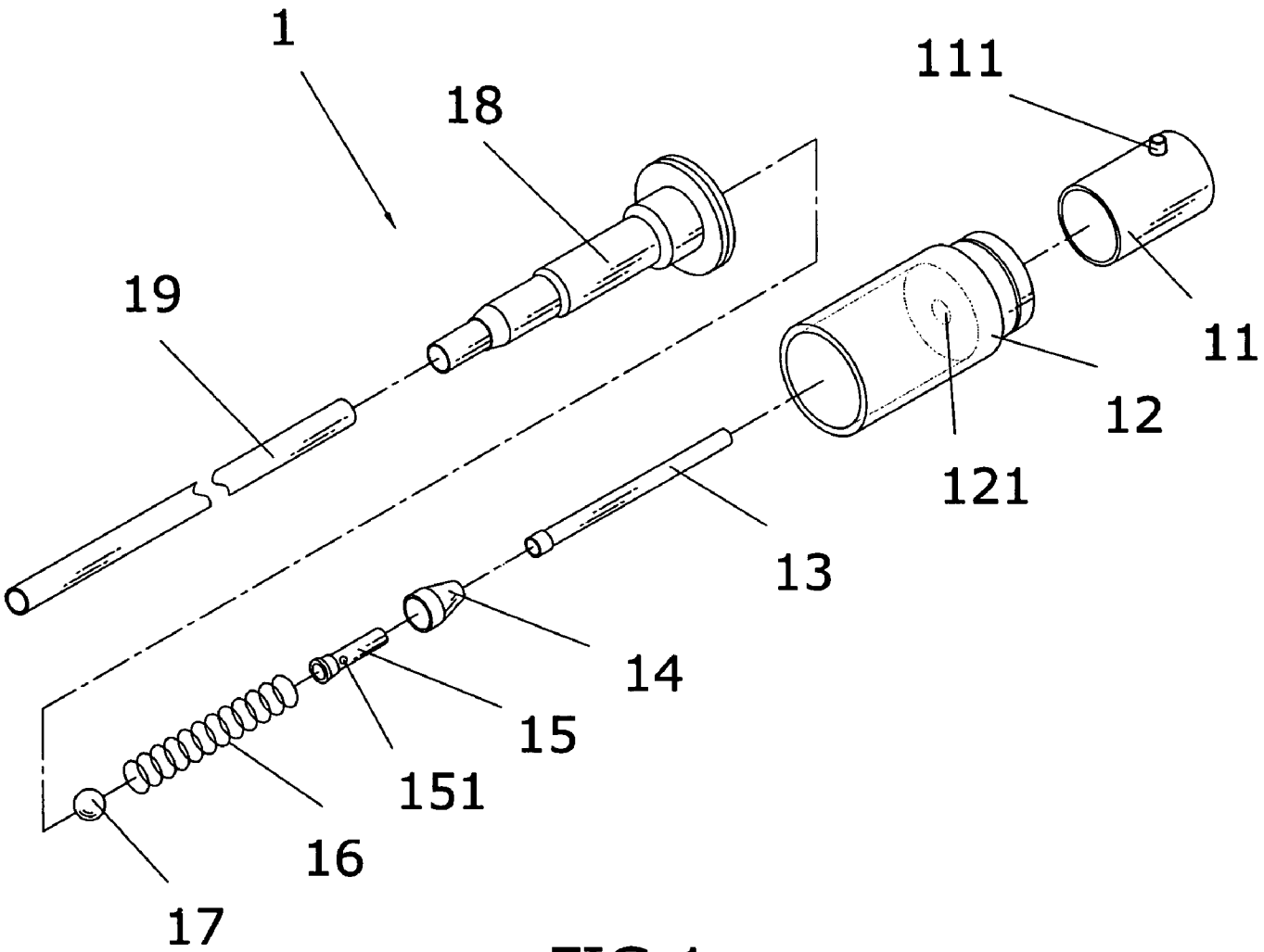
FIG.1 Prior Art
FIG. 1 is an exploded, perspective view showing the prior art nozzle structure.
Figure 2:
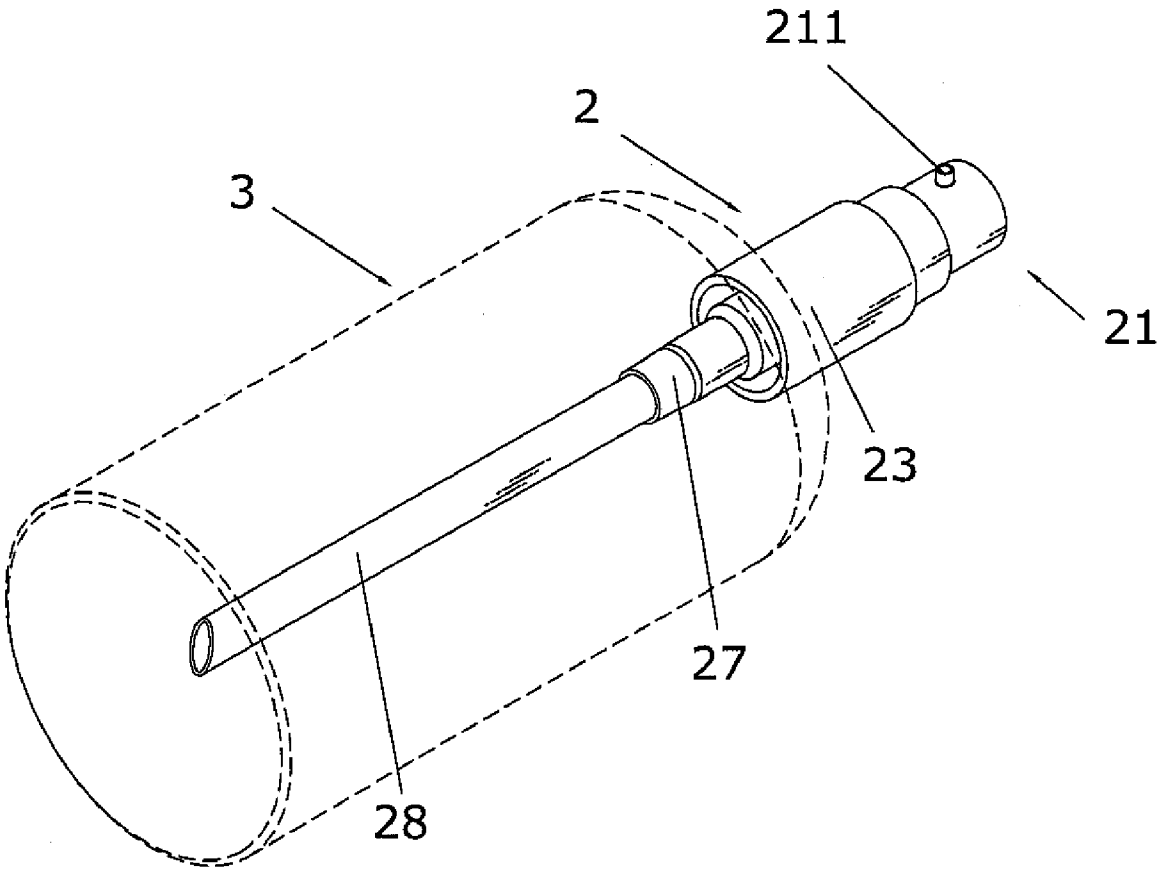
FIG. 2 is a perspective view of a nozzle of the present invention.
Figure 3:
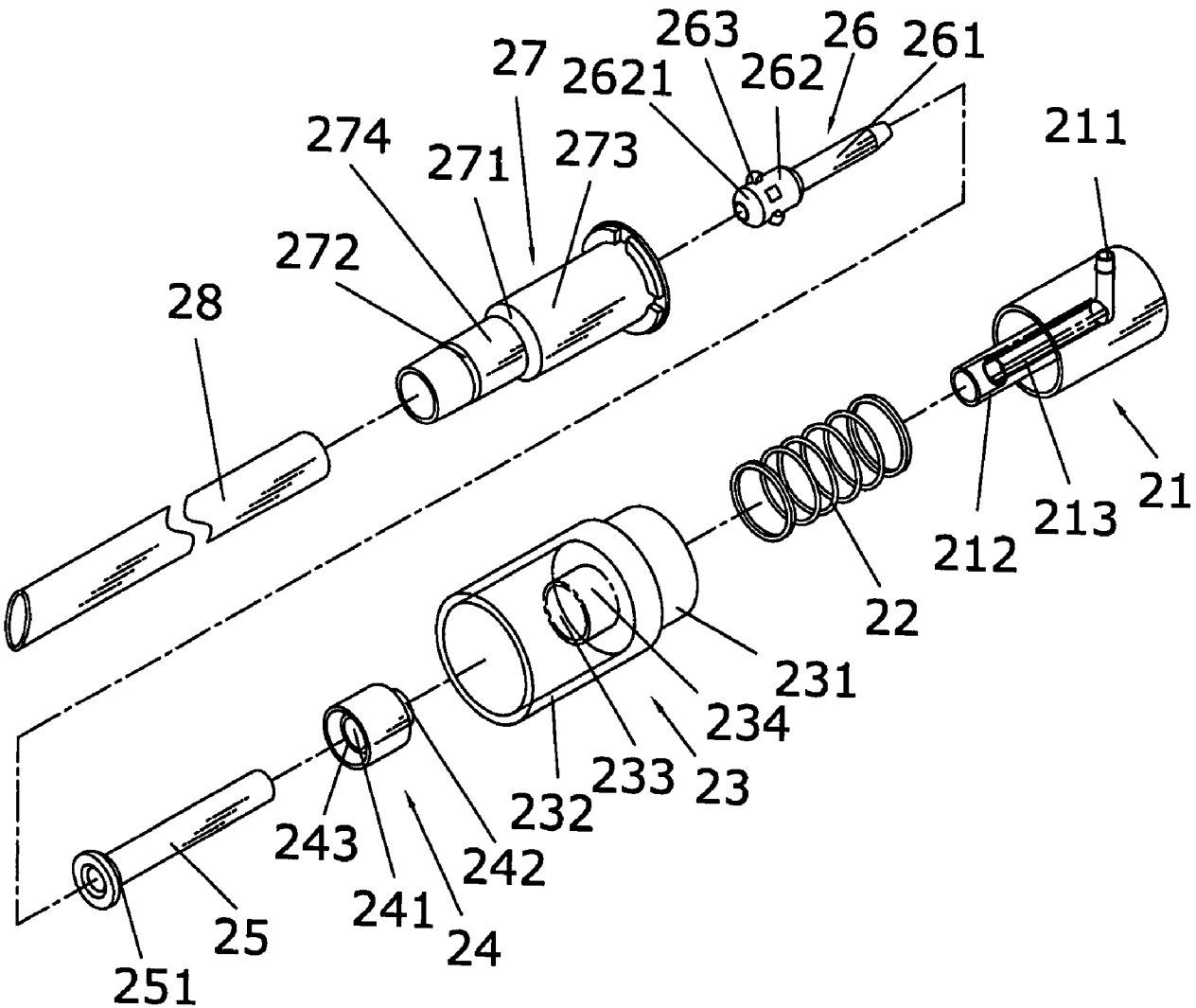
FIG. 3 is an exploded perspective view of the nozzle of FIG. 2.

FIGS. 2 and 3 show the structure for the green nozzle 2 of the present invention to be installed on the opening of a container 3 containing lotion or perfume. Installed horizontally on one side of a pressing body 21 is a nozzle 211. An output tube 212 is installed down vertically from the nozzle 211 and is enclosed by a spring 22.

A fixing cover 23 is installed at the opening of the container and has its upper part installed with a round and dented surface 231. The lower part of the fixing cover 23 is installed with a round rod 232. The round dented surface 231 is for the installation of the spring 22. In addition, a hole 233 is installed at the center of the round dented surface 231. Below the hole 233, a round rod 234 is installed vertically to be penetrated and inserted by the above-mentioned output tube 212.

A piston 24 has a piston hole 241 installed at its center. Upper and lower dented edges 242, 243 are installed vertically at the edge of the piston hole 241. The upper dented edge 242 is to be touched by the bottom edge of the above output tube 212. A connecting rod 25 penetrating and inserting from the bottom to the top into the above piston hole 241 is connected to the output tube 212 of the pressing body 21. The bottom of the connecting rod 25 is installed with a protruding edge 251 touching the lower dented edge 243 of the piston 24.

A switch valve 26 has a valve rod 261 installed on its upper part. The connecting rod 25 is inserted from the bottom. The lower part of the switch valve 26 is installed with a valve body 262. The valve body 262 is installed with some locking pieces 263.

A cylinder 27 is connected to a straw 28 and installed inside the container. The cylinder 27 is installed with upper and lower locking pieces 271, 272 to form upper and lower cylinder rooms 273, 274. The upper cylinder room 273 provides for the installation and assembly of the output tube 212 of the pressing body 21, the piston 24, the connecting rod 25, and the switch valve 26. The lower cylinder room 274 is for the insertion of the valve body 262 of the switch valve 26 so that the valve body 262 can move up and down. The upper locking piece 271 will touch some locking pieces 263 of the valve body 262, and the lower locking piece 272 touches the bottom part 2621 of the valve body 262.

Through the structure and assembly of the above-mentioned components, there will be no metallic material components of the spring 22 inside the cylinder 27. Therefore, liquids such as lotion or perfume inside the container will not get in contact with the spring 22 of metallic material. Thus, chemical change will not happen, and environmental issues can be ignored. In addition, a simplest assembly can be used to reach the function of ejection of the liquid.

From the above descriptions, the inner wall of the output tube 212 of the pressing body 21 is installed with some slot edges 213 for the liquid to flow into. The switch valve 26 replaces the steel ball 17 in the prior art nozzle 1.

Figure 4:
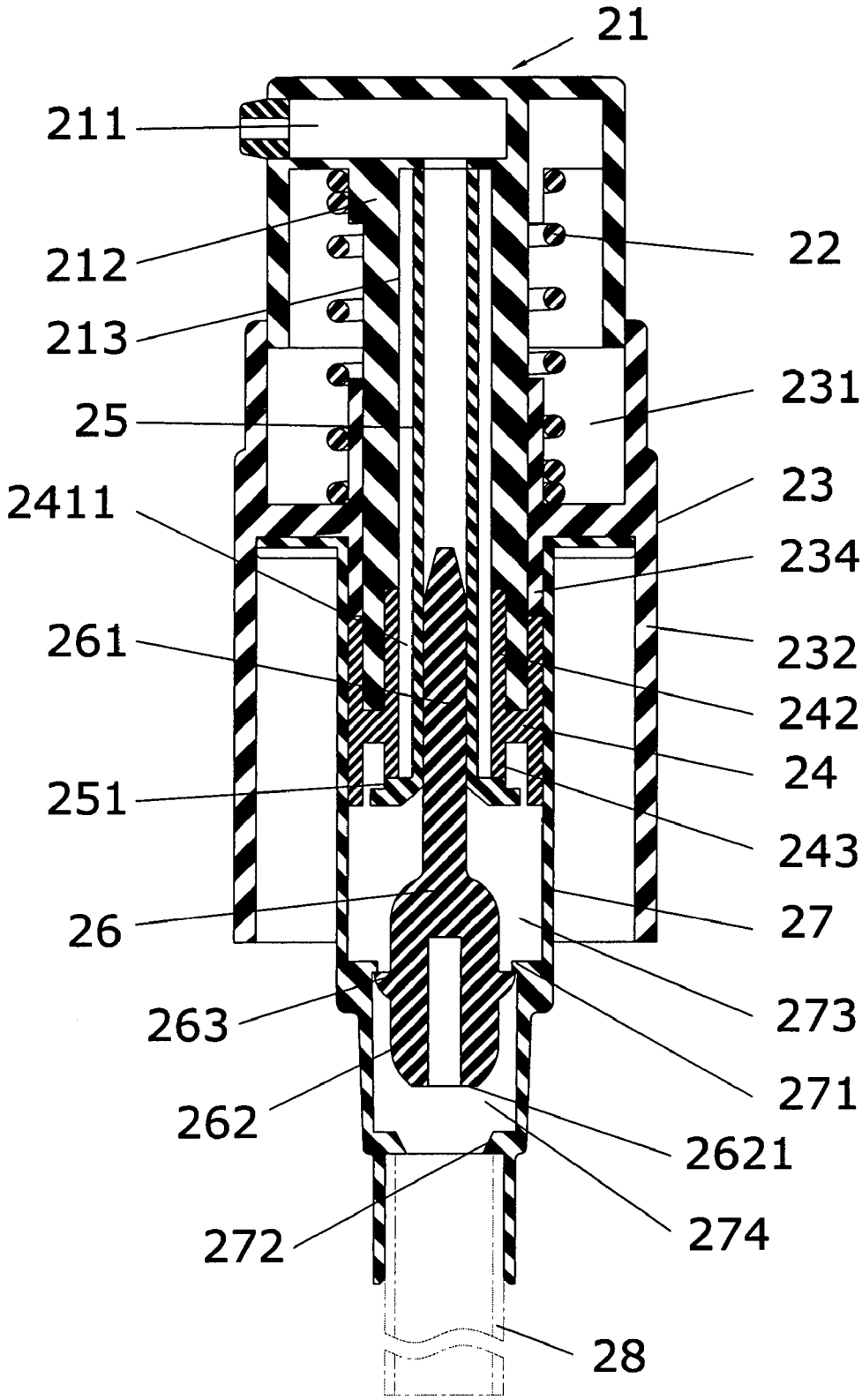
FIG. 4 is a cross sectional view of the nozzle of FIG. 2 in an initial state.

Please refer again to figure 4, before the usage of the present invention, the spring 22 is installed inside the round and dented surface 231 at the upper part of the fixing cover 23. The output tube 212 of the pressing body 21 penetrates and inserts into the spring 22, the fixing cover 23, and the piston 24. The switch valve 26 penetrates into the connecting rod 25 and together is installed inside the cylinder 27. The cylinder 27 is at the inner and lower part of the fixing cover 23, is connected to a straw 28 and is installed further inside the container. The fixing cover 23 is installed at the opening of the container. Thus, the lower dented edge 243 of the piston 24 is locked tight to the protruding edge 251 of the connecting rod 25, and the connecting rod 25 and switch valve 26 form a gap at the upper cylinder room 273 of the cylinder 27. Further the valve body 262 of the switch valve 26 is located at the lower cylinder room 274 of the cylinder 27, the locking piece 263 of the valve body 262 touches the upper locking piece 271, and the liquid such as lotion or perfume are located inside the container and the straw 28.

Figure 5:
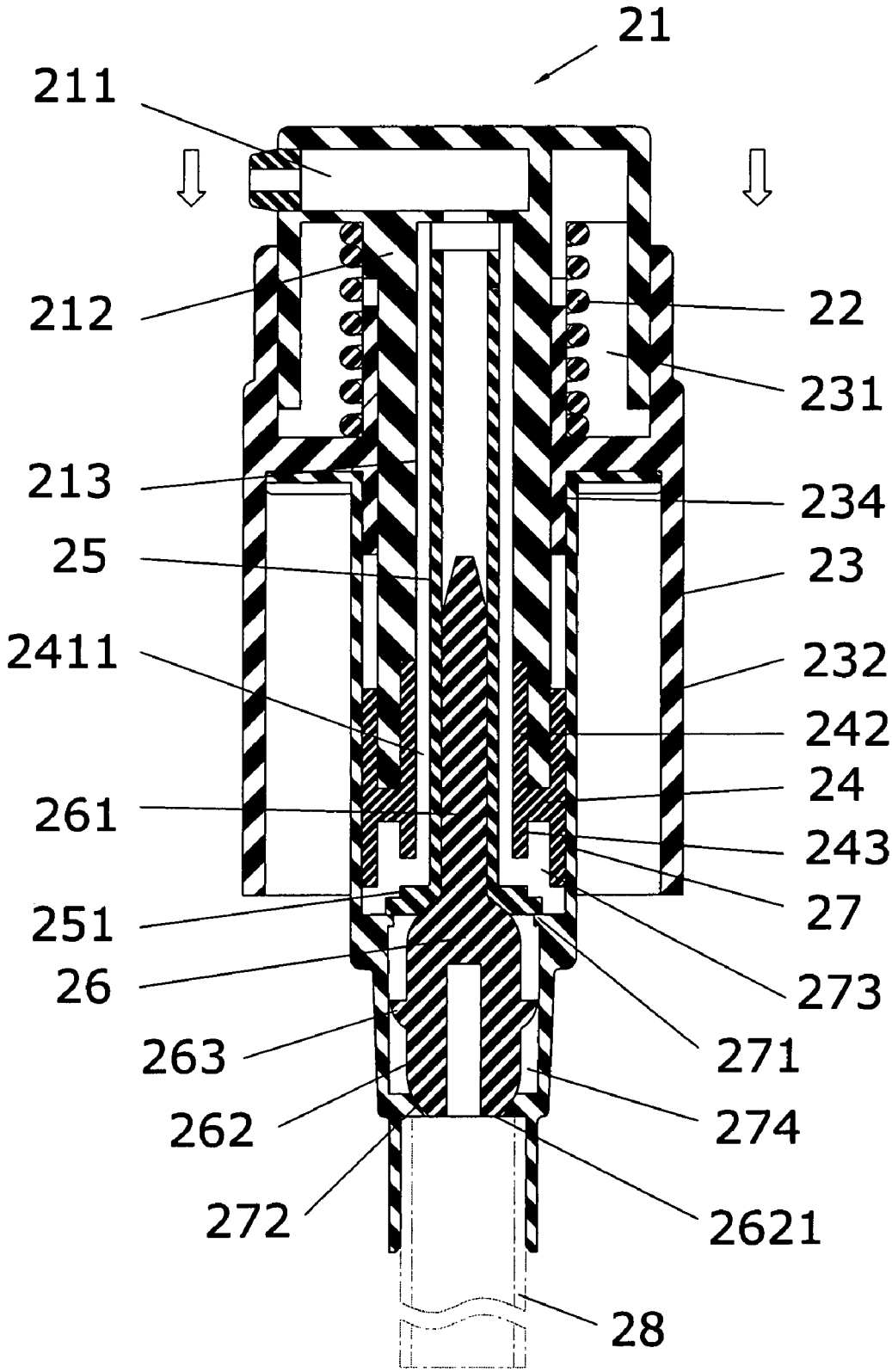
FIG. 5 is a cross sectional view of the nozzle of FIG. 2 in a pressed state.
Figure 6:
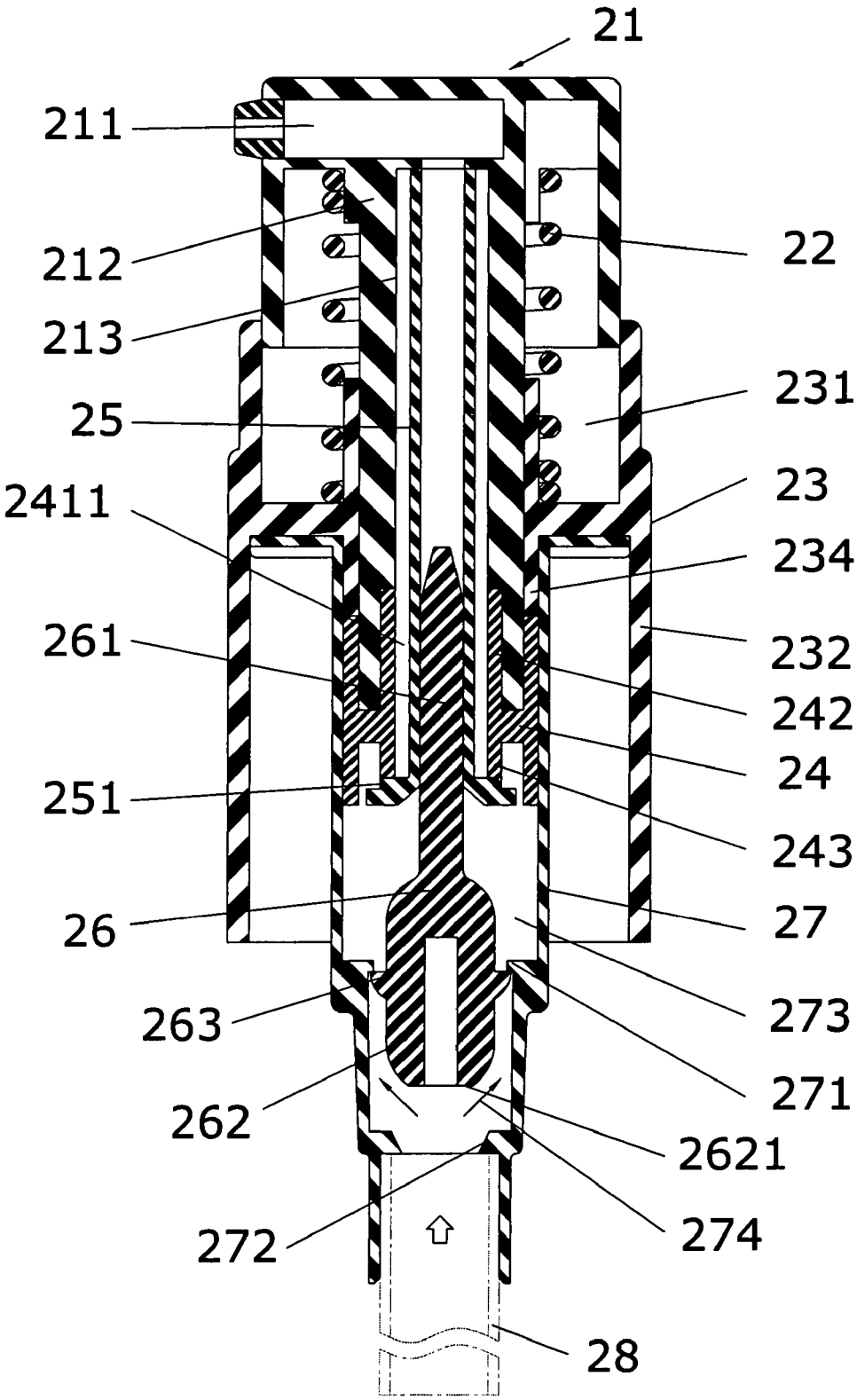
FIG. 6 is a cross sectional view of the nozzle of FIG. 2 in a released state.

From the above descriptions, during the usage of the present invention, as shown in FIG. 5, the pressing body 21 is pressed for the first time so that the connecting rod 25 connected to the output tube 212 of the pressing body 21 will move downwards, which in turn, moves the switch valve 26, and makes the bottom part of the valve body 262 of the switch valve 26 move downwards and touch the lower locking piece 272 of the cylinder 27. The bottom part of the connecting rod 25 closes and touches the upper locking piece 271 of the cylinder 27. When the pressing body 21 is released, as shown in FIG. 6, the spring 22 will then bounce the pressing body 21 up, which in turn moves the connecting rod 25 and the valve body 262 of the switch valve 26 up. At this moment, since air in the container moves upward instantly due to the pressure encountered, the siphon effect generated will produce suction force to the piston 24, and the piston 24 then sucks the liquids such as lotion or perfume inside the container and straw 28 into the upper and lower cylinder rooms 273, 274.

Figure 7:
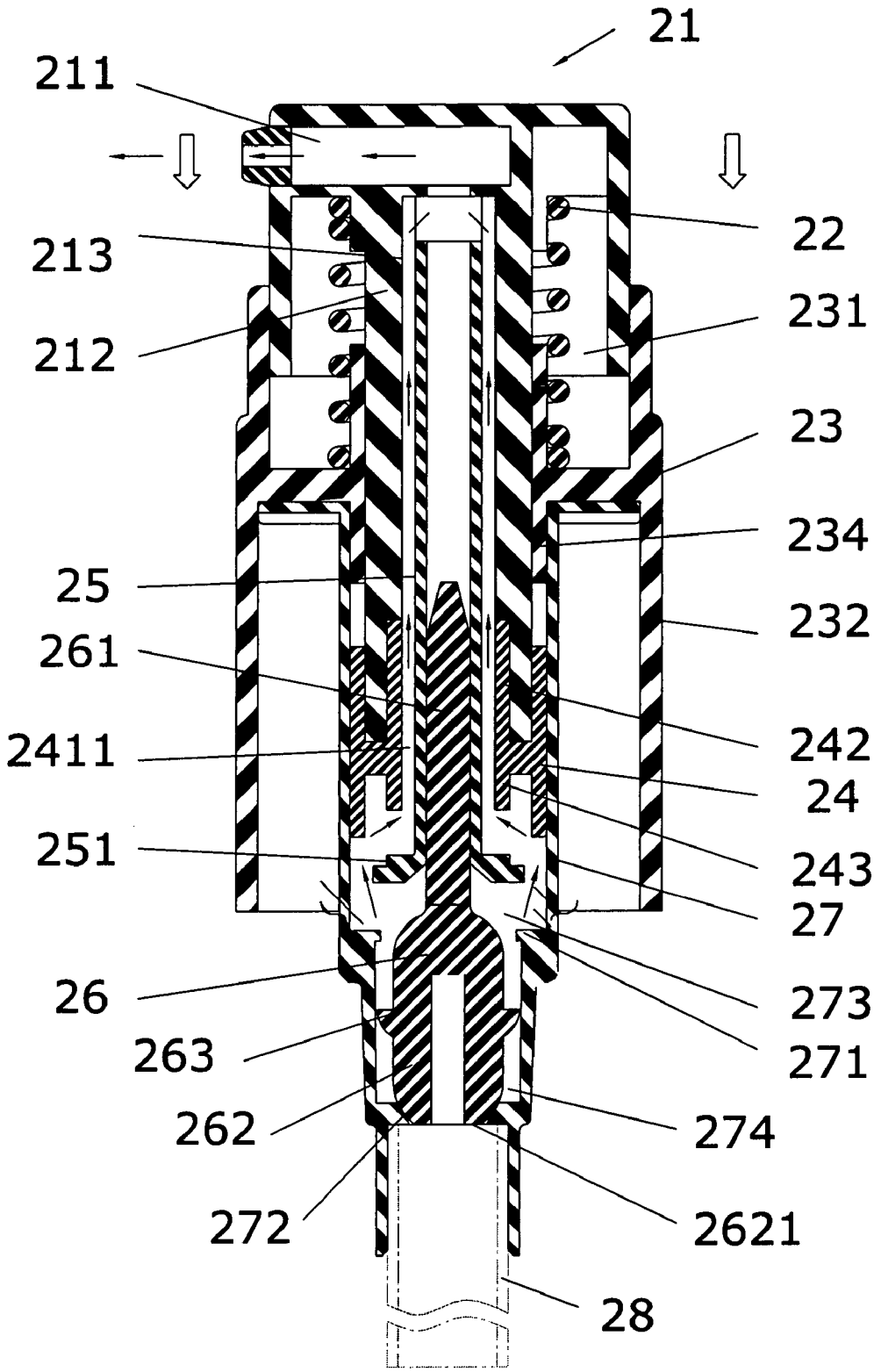
FIG. 7 is a cross sectional view of the nozzle of FIG. 2 in a re-pressed state.

Continued from the above descriptions, after repeated pressing of the pressing body 21 and when the liquids such as lotion or perfume inside the container or straw 28 fill up completely the inside of upper and lower cylinder rooms 273, 274, more pressing on the pressing body 21 will generate compressive force. The compressive force will open the originally closed lower dented edge 243 of the piston 24 and the protruding edge 251 of the connecting rod 25 so that a gap 2411 is generated, as shown in FIG. 7. Liquids such as lotion or perfume will then flow into and then flow through the gap 2411 of the piston 241 into the output tube 212 of the pressing body 21. The liquids then flow through some slot edges 213 installed at the inner walls of the output tube 212 and into the nozzle 211, and finally gets ejected. When the pressing body 21 is released, the lower dented edge 243 of the piston 24 and the protruding edge 251 of the connecting rod 25 bounce up and close naturally again. The liquids such as lotion or perfume inside the container or straw 28 are then sucked into the upper and lower cylinder rooms 273, 274 again. When it is going to be used again, the above steps can be repeated.

In summary, the structure for the green nozzle 2 used in the present invention is installed at the outside of the container through the spring 22 and without steel balls. Therefore, liquids such as lotion or perfume inside the container will not contact with metallic components. Therefore, no chemical changes will happen. The expected purposes and functions can, thus, be achieved and is more environmental friendly, practical and economical than the nozzle 1 of the prior art.

What the invention claimed is:

1. A structure for a green nozzle to be installed at a container having an opening containing liquids, comprising:

a pressing body, wherein one end of the pressing body is installed with a nozzle, wherein one end of the nozzle is installed with a vertically extending output tube to be enclosed by a spring;

a fixing cover installed at the opening of the container, with a round dented surface at an upper part and a round rod at a lower part of the fixing cover, with the round dented surface installing the spring, with a hole installed at a center of the round dented surface, and a small round rod installed vertically at the lower part of the hole to be inserted by the output tube;

a piston installed with a piston hole at a center and with upper and lower dented edges installed at an edge of the piston hole, wherein the upper dented edge is touched by a bottom edge of the output tube;

a connecting rod penetrating and inserted into the piston hole and connected to the output tube, wherein a protruding edge is installed at a bottom part of the connecting rod;

a switch valve having a valve rod installed at an upper part, wherein the valve rod penetrates into the connecting rod, with a valve body installed underneath the valve rod, with upper and lower locking pieces installed on the valve body;

a cylinder connected to a straw and installed inside the container, with the cylinder including upper and lower locking pieces to form upper and lower cylinder rooms, wherein the upper cylinder room receives the output tube, the piston, the connecting rod and the switch valve, with the lower cylinder room receiving the valve body of the switch valve, when the valve body moves up and down, the upper locking piece will touch locking pieces of the valve body, and the lower locking piece of the cylinder touches a bottom part of the valve body.

2. The structure for a green nozzle of claim 1 wherein slot edges are installed at an inner wall of the output tube.

* * * * *